US006119735A

United States Patent [19]

Carter

[11] Patent Number: 6,119,735

[45] Date of Patent: Sep. 19, 2000

[54] FILLING OF TANKS WITH VOLATILE LIQUIDS

[75] Inventor: Rodney Carter, Sawston, United Kingdom

[73] Assignee: Briggs & Stratton Corporation, Wis.

[21] Appl. No.: 09/068,418

[22] PCT Filed: Nov. 13, 1996

[86] PCT No.: PCT/GB96/02767

§ 371 Date: May 13, 1998

§ 102(e) Date: May 13, 1998

[87] PCT Pub. No.: WO97/18155

PCT Pub. Date: May 22, 1997

[30] Foreign Application Priority Data

Nov. 13, 1995 [GB] United Kingdom ..... 9523215

[51] Int. Cl.[7] ..... B67D 5/04

[52] U.S. Cl. ..... 141/59; 141/46; 141/7; 141/255; 141/263; 141/266; 141/290; 137/208; 137/210; 137/533; 137/587

[58] Field of Search ..... 141/7, 46, 59, 141/290, 302, 306; 137/255, 263, 265, 266, 533, 533.17, 506, 512.2, 208, 210, 587

[56] References Cited

U.S. PATENT DOCUMENTS

| | | | |
|---|---|---|---|
| 3,672,180 | 6/1972 | Davis | 62/54 |
| 3,807,433 | 4/1974 | Byrd | 137/255 |
| 3,915,205 | 10/1975 | Wagner et al. | 141/1 |
| 5,289,857 | 3/1994 | Pyles | 141/59 |
| 5,305,807 | 4/1994 | Healy | 141/59 |
| 5,332,008 | 7/1994 | Todd et al. | 141/59 |

FOREIGN PATENT DOCUMENTS

| | | | |
|---|---|---|---|
| 1549236 | 7/1979 | United Kingdom | B67D 5/04 |

*Primary Examiner*—J. Casimer Jacyna
*Attorney, Agent, or Firm*—Michael Best & Friedrich LLP

[57] ABSTRACT

A method of and apparatus for filling a volatile liquid into at least one tank (10) of a multi-tank installation having a vent-pipe (11A, 11B . . . 11F) associated with each tank, all of the vent-pipes being connected to a common vent manifold (13) through respective over-pressure valves (12A, 12B . . . 12F). A vapor extraction manifold (16) is also connected to each over-pressure valve (12A, 12B . . . 12F) and during a tank filling operation is coupled to a vapor extraction mechanism. Both the vent manifold (13) and the extraction manifold (16) are provided with pressure sensitive valves (15, 19) respectively to allow air to enter the manifolds from the ambient when the pressure within the respective manifold falls below atmospheric. On filling any one of the tanks (10), the gas displaced from that tank is distributed amongst all of the tanks until the pressure within all of the tanks reaches some pre-determined value, whereafter the valve (12) associated with the tank (10) being filled operates to connect that tank's vent-pipe (11) to the extraction manifold (16).

9 Claims, 6 Drawing Sheets

FILLING OF TANKS WITH VOLATILE LIQUIDS

BACKGROUND OF THE INVENTION

This invention relates to a method of filling with a volatile liquid at least one tank of a multi-tank installation. The invention further relates to a multi-tank installation for storing volatile liquids, and also to a valve for use in such a multi-tank installation.

Though this invention may be used with a variety of volatile liquids, it find particular application in the filling of underground storage tanks for petrol, as commonly provided at a petrol filling station for motor vehicles. Consequently the invention will be hereinafter be described expressly with reference to that application, though it is to be understood that the invention is not limited to that application.

The usual arrangement at a petrol filling station having a plurality of underground storage tanks is for each tank to have a respective fill pipe through which the tank may be filled with petrol off-loaded from a road tanker. Each tank has a respective first vent pipe, the first vent pipes of all of the tanks being connected together and to a common air egress and inlet pipe provided with a so-called pressure-and-vacuum valve to permit the ingress of air when the pressure within the tanks falls below some pre-set value, as well as releasing excess pressure. This permits the pumping of fuel out of any of the tanks, when demanded by a petrol pump for delivery to a vehicle, as well as safety during the off-loading of petrol from a tanker.

All of the tanks also have a further common vent pipe which is normally closed off but which is connected to a vapour recovery system provided on the road tanker when a delivery of petrol is being made to a tank. The vapour recovery system applies a low level of suction to the further vent pipe as a delivery is being made, to draw air laden with petrol vapour from the tank being filled and to return that vapour to a tank of the road tanker.

It will be appreciated that with the above described arrangement, petrol vapour driven from a tank being filled is returned to the road tanker. Though the volume of petrol vapour recovered in this way on filling any one tank may not be very high, and typically equivalent to only a liter or so of liquid petrol, over a period of time when a considerable number of tanks have been filled, there is a significant marginal loss to a site operator.

SUMMARY OF THE INVENTION

It is a principal aim of the present invention to provide both a method of filling one tank of a multi-tank installation and also apparatus suitable for use in performing such a method, whereby the vapour recovered by a road tanker during the act of filling a tank is minimised, to the advantage of the site operator.

According to one aspect of the present invention, there is provided a method of filling with a volatile liquid at least one tank of a multi-tank installation, wherein there is associated with each tank a vent pipe to permit the ingress of air to the respective tank during tank emptying and the extraction of vapour during tank filling, in which method the vent pipes of all of the tanks are connected together at least for an initial stage of tank filling, and when the pressure within the or each tank being filled reaches a pre-determined value, the vent pipe of the or each tank being filled is connected to an extraction mechanism for said vapour.

With this aspect of the present invention, it will be appreciated that the ullage space of each tank of an entire multi-tank installation is used to accommodate the increasing pressure as any one tank of the installation is being filled. Only once the pressure in all of the tanks has risen to some pre-determined value will the vent pipe of the tank being filled be connected to an extraction mechanism for the vapour, such as the vapour recovery system of a road tanker off-loading petrol into the tank being filled. If only one tank is being filled and there is a significant ullage space in all of the tanks, it is possible that the pressure within all of those tanks will not rise sufficiently for the vent pipe of the tank being filled to be connected to the extraction mechanism. In this case, no vapour will be returned to the tanker, resulting in no loss to the site operator.

Preferably, each vent pipe has associated therewith a respective over-pressure valve which operates automatically when the pressure in the respective tank reaches said pre-determined value, so as to connect only the vent pipe of the tank being filled to the extraction mechanism. In this way, vapour will be drawn only from the tank being filled, once the pre-determined pressure has been reached in all of the tanks. The pressure in the tanks not being filled will then remain at the pre-determined value until there has been at least some condensing of vapour within those tanks In any event, as petrol is drawn from those other tanks to be dispensed into vehicles, the pressure in those other tanks will fall again.

In a preferred form of multi-tank installation, there is provided a vent manifold and an extraction manifold, each vent pipe being connected through a respective over-pressure valve to the vent manifold until said over-pressure valve operates, whereafter the vent pipe is connected through said valve to the extraction manifold. In such an arrangement, the vent manifold should be provided with an inlet valve which opens when the pressure in the vent manifold falls by more than a pre-set amount below atmospheric pressure, just as the first vent pipes of a conventional installation are provided with a vacuum valve, as described above.

In order to optimise operation, the extraction manifold valve may have a pressure sensitive valve which opens to relieve to atmosphere excess pressure in the manifold, and which also opens to allow the ingress of air into the manifold when the pressure therein falls by more than a pre-set amount below atmospheric pressure.

According to a second aspect of the present invention, there is provided a multi-tank installation for storing volatile liquids, which installation comprises a plurality of tanks each having a respective vent pipe, a vent manifold and an extraction manifold, each vent pipe being fitted with an over-pressure valve which normally connects the vent pipe to the vent manifold but which operates to connect the vent pipe to the extraction manifold when the pressure in the respective tank exceeds some predetermined value.

The multi-tank installation of this aspect of the present invention is able to operate in accordance with the method of this invention as defined hereinbefore.

Each over-pressure valve of the installation may have a valve body in which is slidably mounted a valve member normally disposed at a first position but able to move to a second position under the influence of pressure in the vent pipe to which the valve is connected. When in the first position, the valve connects the respective tank vent pipe to the vent manifold, but when the pressure in the associated tank rises to the pre-determined value the valve member moves to its second position, so closing off the vent pipe from the vent manifold and instead connecting the vent pipe to the extraction manifold. This connects the vapour recovery system to the tank vent pipe, though the pressure in the other tanks will remain at the raised value, since those other tanks are not connected to the extraction manifold.

Preferably, the valve member is provided with a safety pressure release valve, which will open in the event that the pressure within a tank being filled rises significantly above the pressure at which the valve member should have moved to its second position, but did not do so. The safety pressure release valve will thus operate only should there be a failure in the over-pressure valve itself, so preventing the normal operation of the valve.

The over-pressure valve may be provided with an indicator device which is operated if the pressure in the respective vent pipe rises sufficiently for the safety pressure release valve to open. In this way, a site operator may be warned that a valve has not operated in the required manner.

Preferably, the valve is arranged in a generally vertical disposition—that is to say with the axis of movement of the valve member generally vertical. In this way, the valve member may normally rest at its first said position under the influence of gravity, the valve member being moved to its second position against gravitational force by pressure within the vent pipe.

This invention extends to an over-pressure valve as described hereinbefore, for fitting to the vent pipe of a storage tank for a volatile liquid.

In order that the invention may better be understood, one specific example thereof will now be described in detail, reference being made to the accompanying drawings, in which:

DESCRIPTION OF PREFERRED EMBODIMENT

Figure 1:
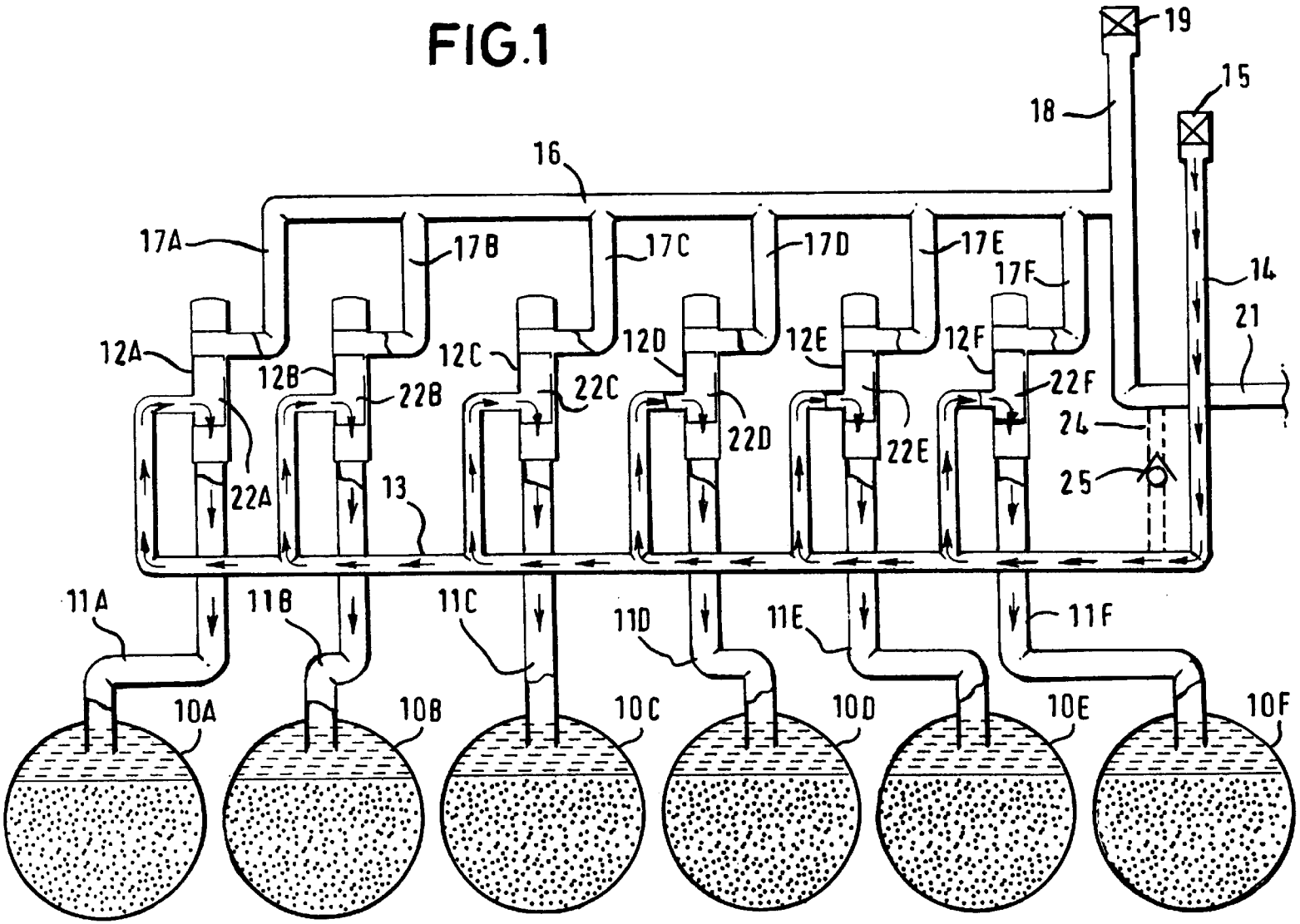
FIG. 1 illustrates a six-tank installation provided with a vent pipe arrangement according to this invention, there being an over-pressure valve for each vent-pipe and all of those valves being in the "selling" mode.
Figure 2:
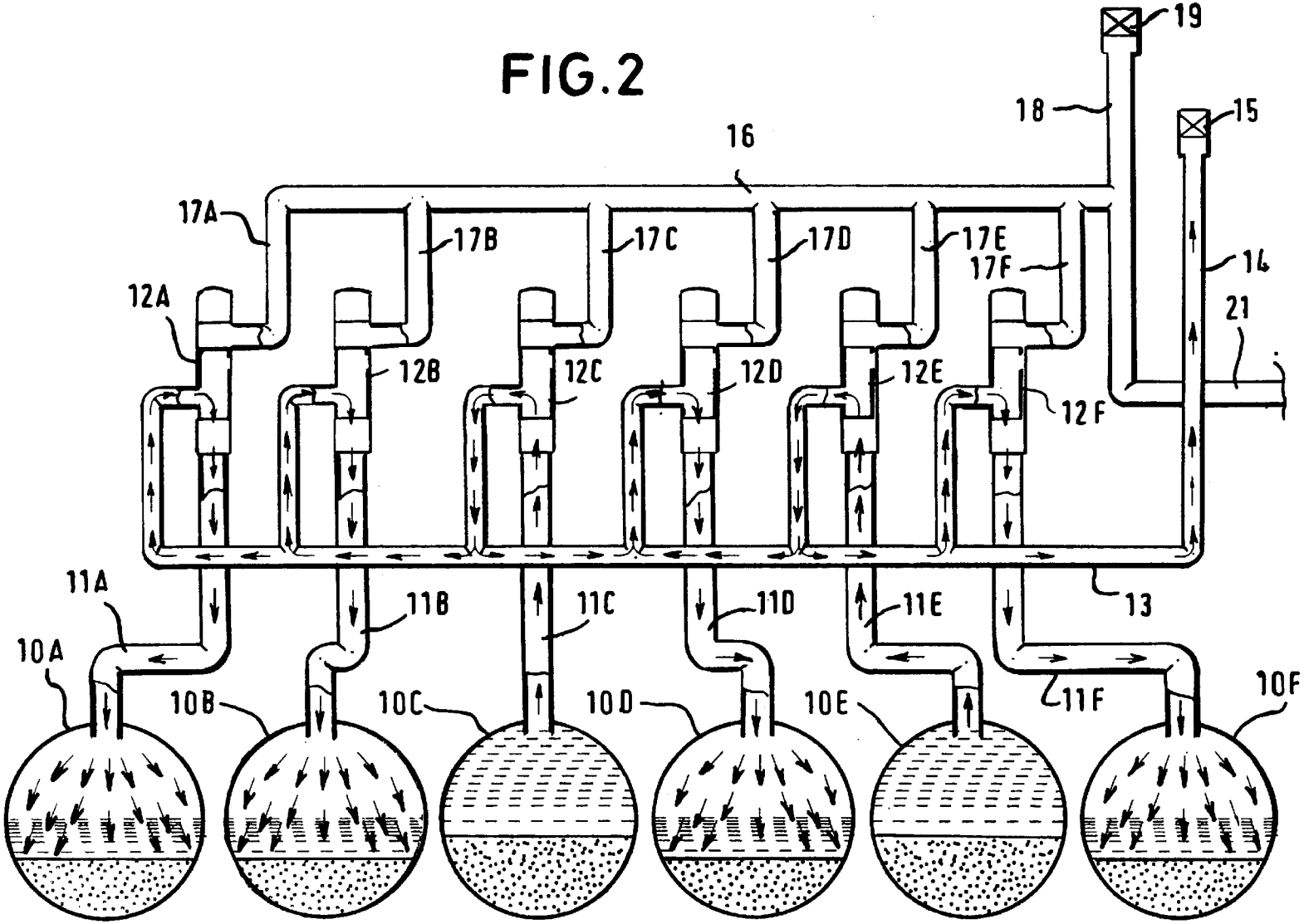
FIG. 2 is similar to FIG. 1, but showing the off-loading of petrol into two of the tanks.
Figure 3:
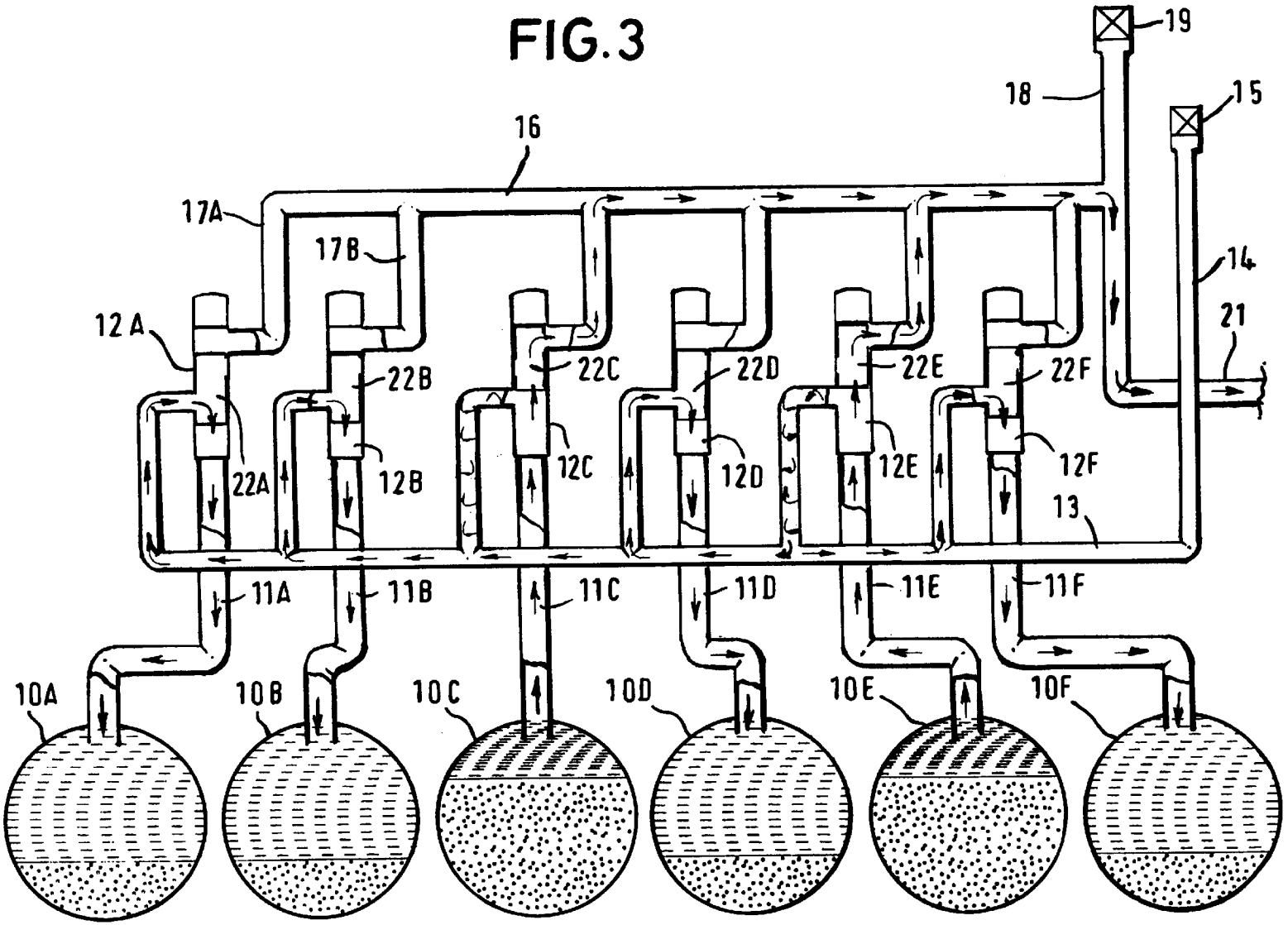
FIG. 3 shows the arrangement of FIGS. 1 and 2 but when the pressure in the two tanks being filled has risen to a pre-determined level.

FIGS. 1 to 3 show diagrammatically the tank installation and vent pipe arrangement of a petrol-filling station, comprising an embodiment of this invention. There are six underground storage tanks 10A, 10B . . . 10F, each of which has a respective vent pipe 11A, 11B . . . 11F, each vent pipe extending generally vertically and being provided at its upper end with a respective over-pressure valve 12A, 12B . . . 12F. The installation includes a vent manifold 13, each tank vent pipe 11A, 11B . . . 11F, being normally connected to that manifold through the respective over-pressure valve 12A, 12B . . . 12F. The manifold 13 includes an ambient vent duct 14 provided with a vacuum valve 15 at its free end. The valve 15 is normally closed but opens to admit air into the duct 14 when the pressure in that duct is at some pre-set sub-atmospheric value—and typically 28 mB below atmospheric pressure. The valve 14 could also have a pressure relief function, arranged to operate typically at 35 mB above atmospheric pressure, so as to increase safety in operation.

The installation further includes an extraction manifold 16 which is connected to each of the over-pressure valves 12A, 12B . . . 12F, though branch pipes 17A, 17B . . . 17F. Normally, with the over-pressure valves in the settings shown in FIG. 1, the respective tank vent pipes 11A, 11B . . . 11F are not connected to the extraction manifold 16, but when any one over-pressure valve 12A, 12B . . . 12F operates, then the vent pipe of the tank of the operated valve is connected to the extraction manifold 16.

An extraction duct 18 is connected to the extraction manifold 16 and is provided at its free end with a pressure/vacuum valve 19. This valve opens either if the pressure in the duct 18 is more than 35 mB above atmospheric pressure, to relieve that excess pressure, or if the pressure within the duct 18 is more than 20 mB below atmospheric pressure, so as to allow the ingress of air to the duct 18. In addition, the manifold 16 is connected to an extraction pipe 21 provided at its free end with a suitable connector (not shown) to permit the connection thereto of a flexible hose from a road tanker vapour recovery system. The connector includes a valve which is normally closed until the tanker flexible hose has been connected thereto.

FIG. 1 shows all of the over-pressure valves 12A, 12B . . . 12F, in their respective first positions, with their respective Valve members 22A, 22B . . . 22F, connecting the various vent pipes to the vent manifold 13. This is the normal setting for each over-pressure valve, when petrol is being dispensed on demand by petrol pumps connected to the various tanks. If fuel is drawn from any tank 10A, 10B . . . 10F, the pressure in that tank will fall, and air will be drawn into that tank through its vent pipe 10, valve 22, manifold 13 and over-pressure valve 12, as shown by the arrows in FIG. 1.

When one or more tanks are to be filled from a road-tanker, hoses are connected as appropriate from the tanker to the tank fill pipes. FIG. 2 shows the filling of tanks 10C and 10E. Initially, the ullage spaces of all of the tanks are connected together through the respective valves 12A, 12B . . . 12F, and manifold 13. As tanks 10C and 10E are filled, air is driven out of those tanks, but the rise in pressure is spread amongst all of the tanks, as shown by the arrows in FIG. 2. Thus, the pressure in all of the tanks rises more or less uniformly, until a pre-set pressure is reached, of typically 38 mB above atmospheric pressure.

FIG. 3 shows the situation which prevails when the pressure in the tanks being filled rises above the pre-set pressure, as described above. Here, the over-pressure valves 12C and 12E, associated with tanks 10C and 10E, have moved to their second positions, on account of the increasing pressures in those tanks, so connecting the tank vent pipes 11C and 11E to the extraction manifold 16. As filling continues, air laden with petrol vapour and driven from tanks 10C and 10E will pass into the extraction manifold 16 and then be drawn along pipe 21 to the vapour recovery system of the road tanker. The vent pipes of the remaining tanks are isolated from the extraction manifold 16 but are all still connected to the vent manifold 13 and so to the vacuum valve 15, to permit air to enter any of those tanks in the event that sufficient petrol is drawn from one or more of those tanks to bring the pressure thereon to less than atmospheric.

Before operation of the over-pressure valves 12C and 12E, the pressure rises substantially uniformly within all of the tanks, as the ullage spaces of all of the tanks are connected together. Thus, the increase in pressure within the combined ullage space is at a much slower rate than would be expected were the tank being filled isolated from the others.

A modification of the vent-pipe arrangement of FIGS. 1 to 3 is shown in broken lines in FIG. 1. A pipe 24 interconnects manifolds 13 and 16, and a one-way valve 25 is positioned in that pipe such that when the pressure in the vent manifold 13 (primary vent circuit) falls below the pressure in the extraction manifold 15 (secondary vent circuit), the valve will open to allow the flow of air into the manifold 13. This will draw air through the pressure/vacuum valve 19 in parallel with the drawing of air through valve 15, and help to minimise any negative pressure in the system, as well as providing a safety feature in the event that either valve 15 or 19 should fail closed.

Figure 4:
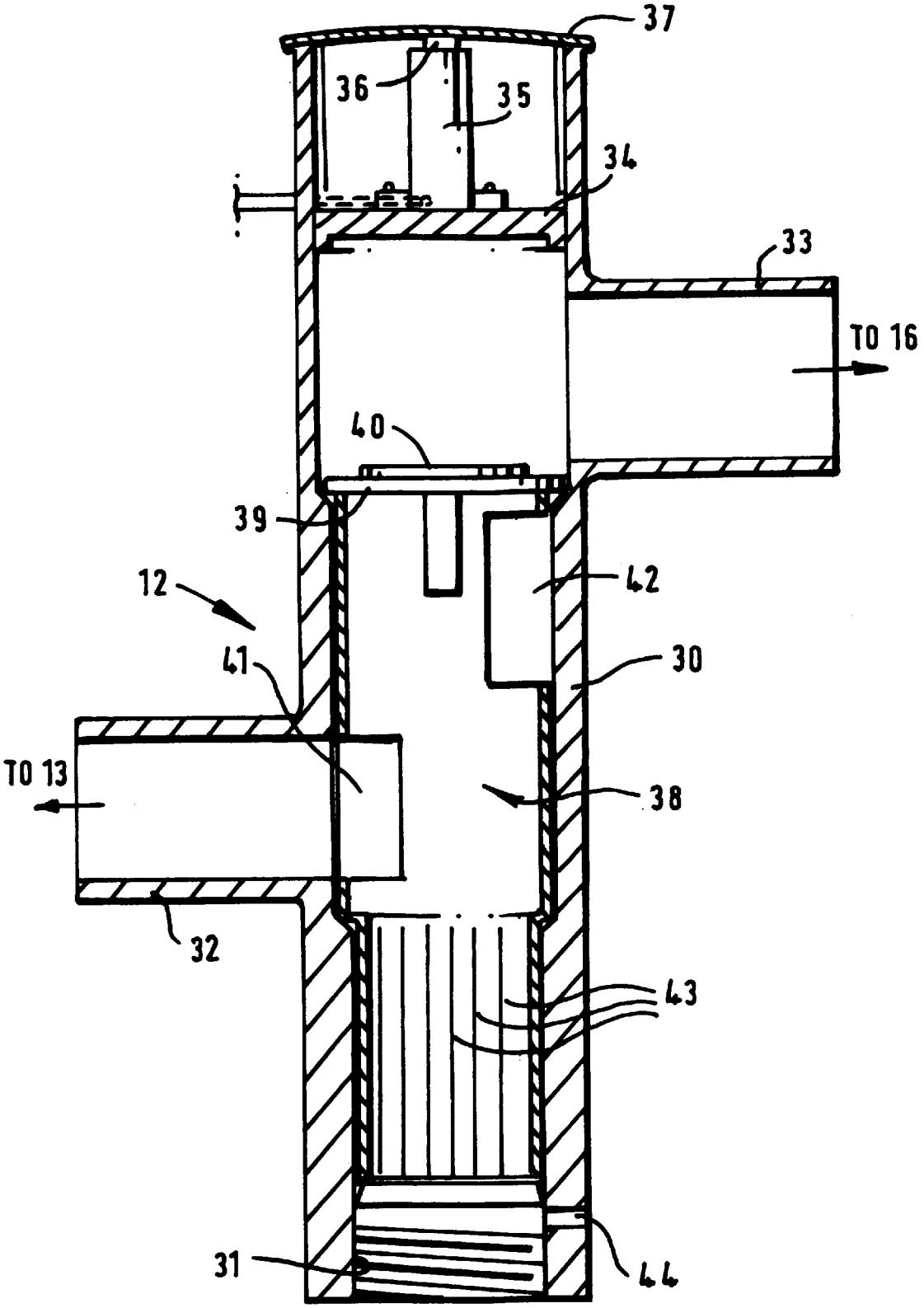
FIG. 4 is a diagrammatic sectional view of one of the over-pressure valves used in the installation of FIGS. 1 to 3, which valve is in its first position.
Figure 5:
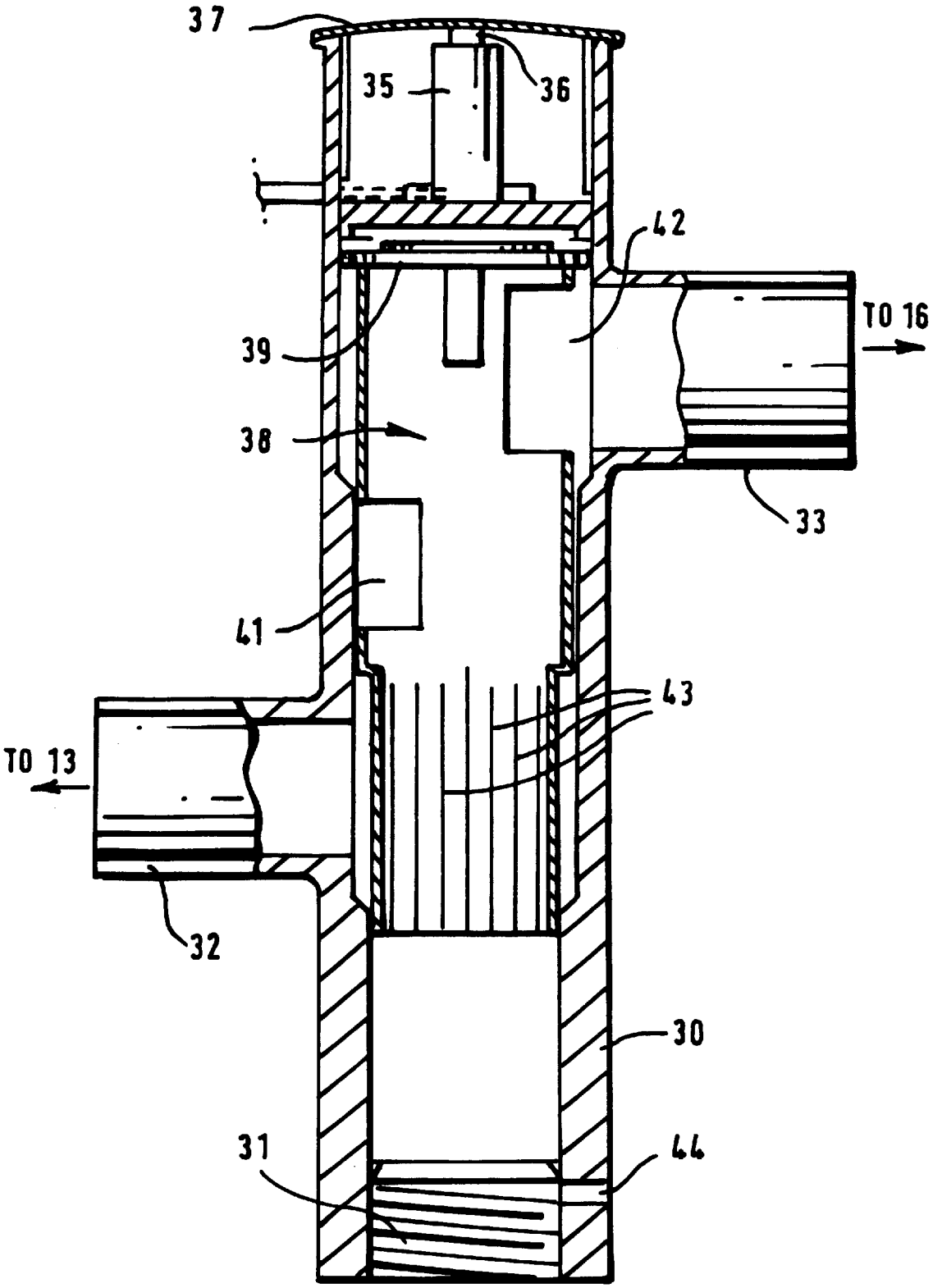
FIG. 5 is a view similar to that of FIG. 4 but with the valve in its second opposition.
Figure 6:
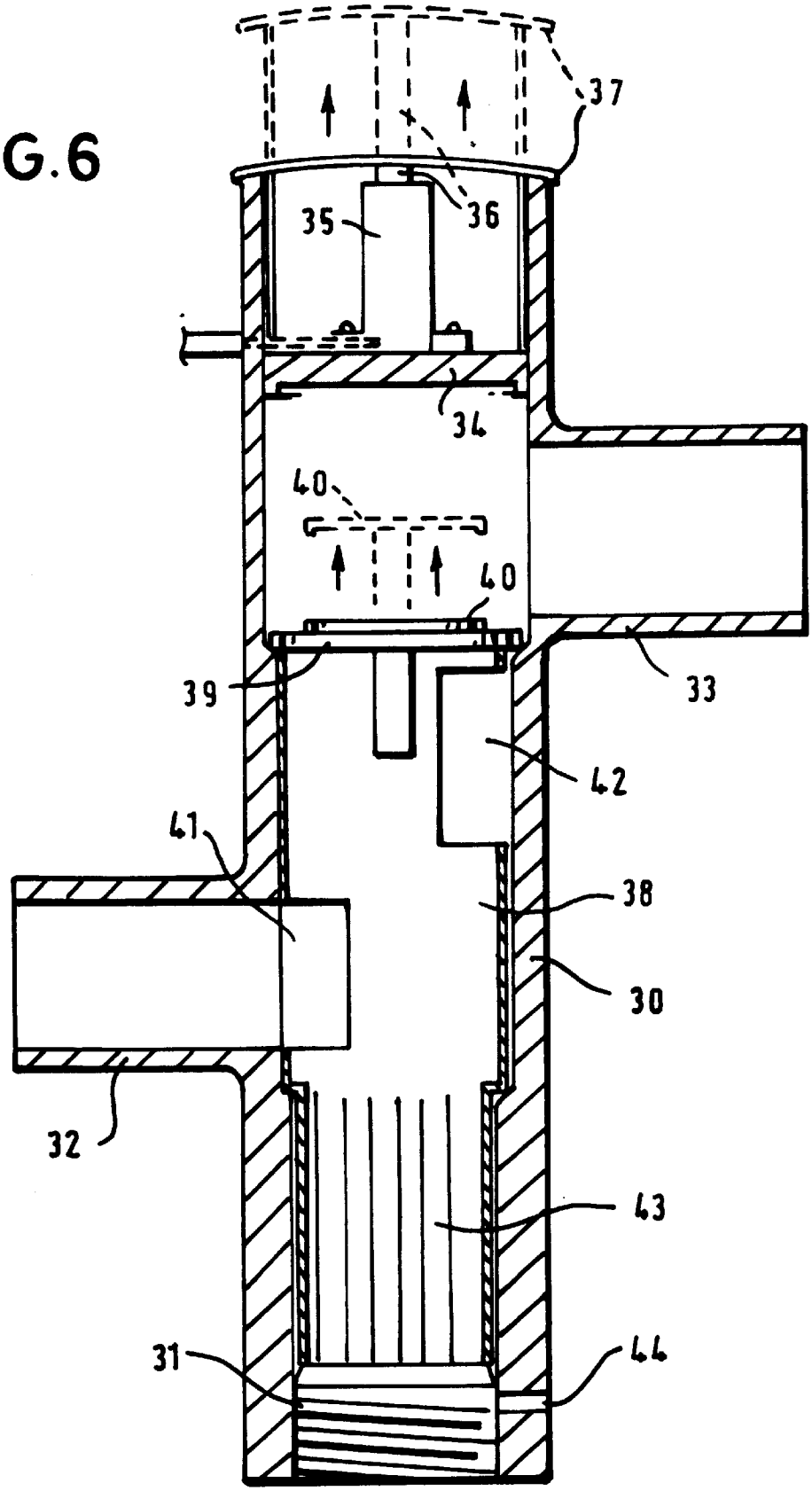
FIG. 6 is a view similar to that of FIG. 4 but with a safety valve released.

FIGS. 4 to 6 show one of the over-pressure valves 12 described above. The valve has a cylindrical valve body 30 provided at its lower end with a threaded portion 31, to permit the mounting of the valve on a respective tank vent pipe 11 with the axis of the valve generally vertical. A vent stub pipe 32 communicates with the interior of the valve body at a position spaced upwardly from the lower end of the body and is arranged for the connection thereto of a pipe leading to vent manifold 13. Above that, there is provided a further stub pipe 33 adapted to permit the connection thereto of a respective branch pipe 16, leading to the extraction manifold 15. The valve body 30 is closed internally above stub pipe 33 by means of a plate 34. Mounted on that plate 34 is a pneumatic cylinder 35 having a piston rod 36 which carries a cap 37. The cap normally rests on the valve body 30 but will be raised upon the supply of air under pressure to the cylinder 35.

Slidably mounted within the valve body 30 is a hollow valve member 38 closed at its upper end by disc 39. That disc carries a safety pressure relief valve 40, spring-biased to the closed position but which may move to an open position as shown in broken lines in FIG. 6 should the pressure within the valve member 38 rise to some relatively high pre-set value. The valve member 38 has ports 41 and 42 formed through the wall thereof, in order to permit communication with the stub pipes 32 and 33, when the valve member is appropriately positioned axially within the valve body 30. Within the lower part of the valve member 38, there may be provided condenser plates 43 arranged parallel to the valve axis, in a grid formation, but their places are optional.

The normal condition of the valve is shown in FIG. 4, where the valve member allows communication between the vent pipe to which the valve is connected and the vent manifold 13. When the pressure within the vent pipe rises to 35 mB above atmospheric pressure, the valve member 38 moves against gravity to its second position, shown in FIG. 5. Here, the vent pipe is disconnected from the vent manifold but is instead connected to the extraction manifold 16.

In the event that the pressure within a vent pipe rises above 35 mB over atmospheric pressure, but the valve member 38 does not move to its second position (FIG. 5), the pressure within a port 44 provided through the valve body 30 adjacent threaded portion 31 will also rise. That port 44 is connected by a pipe (not shown) to the cylinder 35 and so will cause the cap 37 to lift, as shown in FIG. 6. This gives an over-pressure warning to the site operator. If the pressure continues to rise, the safety over-pressure valve 40 will open, also as shown in FIG. 6, so allowing communication between the vent pipe and the extraction manifold.

What is claimed is:

1. A multi-tank installation for storing volatile liquids, comprising a plurality of tanks each having a respective vent pipe, a vent manifold and an extraction manifold, each vent pipe being fitted with an over-pressure valve which normally connects the vent pipe to the vent manifold but which operates to connect the vent pipe to the extraction manifold when the pressure in the respective tank exceeds some pre-determined value.

2. An installation as claimed in claim 1, wherein each over-pressure valve has a valve body in which is slidably mounted a valve member, the valve being arranged to apply to the valve member the pressure in the vent pipe to which the valve is connected.

3. An installation as claimed in claim 2, wherein each over-pressure valve is mounted with its axis generally vertical and the associated valve member is maintained at a first position by gravitational force until acted upon by sufficient pressure in the respective vent pipe.

4. An installation as claimed in claim 1, wherein each over-pressure valve is provided with a safety pressure relief valve adapted to open should the pressure in the respective vent pipe exceed a pre-set value.

5. A method of filling at least one tank of a multi-tank installation with a volatile liquid, comprising:

providing each tank with a vent pipe to permit the ingress of air to the respective tank during tank emptying and the extraction of vapour during tank filling;

connecting the vent pipes of all of the tanks together at least for an initial stage of tank filling;

connecting a vent pipe for a tank being filled to an extraction mechanism for said vapour when the pressure within a tank being filled reaches a pre-determined value; and providing a respective over-pressure valve for each vent pipe that operates automatically when the pressure in the respective tank reaches said pre-determined value to connect the vent pipe of the respective tank to the extraction mechanism.

6. The method as claimed in claim 5, further comprising:

providing a vent manifold and an extraction manifold;

connecting each vent pipe through over-pressure to the vent manifold until said over-pressure valve operates; and connecting the vent pipe that is connected to the vent manifold through said valve, to the extraction manifold.

7. The method as claimed in claim 6, further comprising:

providing an inlet valve associated with the vent manifold; and opening said inlet valve when the pressure in the vent manifold falls to more than a pre-set amount below atmospheric pressure.

8. The method as claimed in claim 6, further comprising:

providing a pressure sensitive valve associated with the extraction manifold that operates to relieve excess pressure in the extraction manifold, and that also operates to allow the ingress of air to the extraction manifold when the pressure in the extraction manifold falls by more than a pre-set amount below atmospheric pressure.

9. The method as claimed in claim 5, further comprising:

providing a gasoline filling station that includes said multi-tank installation; and filling at least one tank from a road tanker that is provided with said extraction mechanism to which the vent pipe of the tank being filled is connected when the vapour pressure in the tank reaches said pre-determined value.

* * * * *

UNITED STATES PATENT AND TRADEMARK OFFICE

CERTIFICATE OF CORRECTION

PATENT NO. : 6,119,735
DATED : September 19, 2000
INVENTOR(S) : Rodney Carter

It is certified that error appears in the above-identified patent and that said Letters Patent is hereby corrected as shown below:

Title page,
Item [73], should be deleted

Signed and Sealed this

Third Day of July, 2001

*Attest:*

Nicholas P. Godici

*Attesting Officer*

NICHOLAS P. GODICI
*Acting Director of the United States Patent and Trademark Office*